US006284708B1

(12) United States Patent
Oshima et al.

(10) Patent No.: US 6,284,708 B1
(45) Date of Patent: Sep. 4, 2001

(54) INTERMEDIATE TRANSFER RECORDING MEDIUM AND METHOD FOR FORMING IMAGE

(75) Inventors: Katsuyuki Oshima; Shinichi Kurokawa; Masayasu Yamazaki, all of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/506,190

(22) Filed: Feb. 17, 2000

(30) Foreign Application Priority Data

Feb. 19, 1999 (JP) ..... 11-041440

(51) Int. Cl.[7] ..... B41M 5/035; B41M 5/38

(52) U.S. Cl. ..... 503/227; 156/235; 428/42.2; 428/42.3; 428/43; 428/195; 428/913; 428/914

(58) Field of Search ..... 8/471; 156/235; 428/195, 42.2, 42.3, 43, 913, 914; 503/227

(56) References Cited

U.S. PATENT DOCUMENTS 4,923,848 * 5/1990 Akada et al. ..... 503/227

FOREIGN PATENT DOCUMENTS 62238791 10/1987 (JP) .

* cited by examiner

*Primary Examiner*—Bruce H. Hess
(74) *Attorney, Agent, or Firm*—Ladas & Parry

(57) ABSTRACT

The present invention provides an intermediate transfer recording medium which is used to form an image on a transfer-receiving member and a protective layer on the image to thereby impart durability to the image perfectly and which can simply transfer the protective layer to the image with high accuracy and also provides an image forming method. In the intermediate transfer recording medium (1) of the invention, a sheet substrate (4) provided with a resin layer (5) and a transparent sheet (2) provided with a receptor layer (3) are laminated on each other such that the resin layer (5) is peelable from the transparent sheet (2), wherein a portion of the transparent sheet (2) including the receptor layer (3) is provided with half-cut treatment (6). Using the intermediate transfer recording medium (1), a transfer image is formed on the receptor layer (3) and only the image-formed portion is retransferred to the transfer-receiving member to form an image. At this time, because a portion of the transparent sheet (2) is cut at the half-cut portion (6) as the boundary, forming a structure in which the transparent sheet (2) covers the image-formed portion and the transparent sheet functions as a uniform and strong protective layer, necessary durability is imparted perfectly to the image.

15 Claims, 5 Drawing Sheets

INTERMEDIATE TRANSFER RECORDING MEDIUM AND METHOD FOR FORMING IMAGE

BACKGROUND OF THE INVENTION

The present invention relates to an intermediate transfer recording medium which is used to form an image on a transfer-receiving member and a protective layer on the image to thereby impart durability to the image and which can simply transfer the protective layer to the image with accuracy. The present invention also relates to an image forming method.

Conventionally, various thermal transfer methods have been known in which, a thermal transfer sheet formed with a color transfer layer on a substrate sheet is heated image-wise from the backface thereof by using a thermal head to thermally transfer the above color transfer layer to the surface of a thermal transfer image-receiving sheet thereby forming an image.

These thermal transfer methods are loosely classified into two systems, namely, a sublimation transfer type and a heat melting transfer type depending upon the structure of the color transfer layer. The two systems enable the formation of a full-color image. For instance, thermal transfer sheets with three colors of yellow, magenta and cyan or with four colors including a black color as required in addition to the above three colors are prepared and each color image is overlapped on and thermally transferred to the same thermal transfer image-receiving sheet to form a full-color image.

With the progresses of various hardware and software applications in relation to multimedia, markets for the thermal transfer method have been broaden in the fields of full-color hard copy systems used for computer graphics, static images sent by satellite communications, digital images represented by those of CD ROMs and the like and analog images of videos and the like.

Specific applications of the thermal transfer image-receiving sheet used in this thermal transfer method are diversified. Typical examples of the application include proof of printing, outputs of images, outputs of layout and design in CAD/CAM, output applications for various medical analysis or measuring instruments, e.g., CT scans and endscope cameras, substitutions for instant photographs, outputs of photographs of a face and the like in papers of identification, ID cards, credit cards and other cards, combination photographs and commemorative photographs handled in amusement facilities, e.g., amusement parks, game centers, museums and aquariums.

Along with the diversification of applications as aforementioned, there has been an increased demand for forming a thermal transfer image on an optional subject. As one of measures devised to deal with the demand, a method is proposed in which using an intermediate transfer recording medium provided peelably with a receptor layer on a substrate wherein a thermal transfer sheet having a dye layer is used as the receptor layer, a dye is transferred to form an image and thereafter the intermediate transfer recording medium is heated to transfer the receptor layer to a transfer-receiving member (see Japanese Patent Application Laid-Open No. 62-238791).

When a sublimation transfer-type thermal transfer sheet is used to form an image, gradational images such as photographs of a face can be formed precisely. However, this method has weak points that, unlike an image formed by usual printing ink, the formed image lacks in durability regarding, for example, weatherability, friction resistance and chemical resistance.

To solve the problem, a protective layer thermal transfer film having a thermal transfer resin layer is overlapped on a thermal transfer image and the thermal transfer resin layer having transparency is transferred using a thermal head or heating roll to form a protective layer on the image.

The above protective layer must have layer-cuttability because it must be transferred in part when it is transferred using a thermal head or a heating roll. In this case, it is inevitable that the protective layer is formed of a resin film with a thickness of about several microns and it is hence impossible to make the protective layer possess durability regarding, for example, strong resistance to abrasion and chemical resistance.

Also, a protective layer to be formed on an intermediate transfer recording medium is not made to have durability regarding, for example, strong resistance to abrasion and chemical resistance in view of the necessity of layer cuttability.

There will be a method in which an image is formed on a transfer-receiving member by using an intermediate transfer recording medium and a resin film is laminated so as to cover the image on the transfer-receiving member to form a protective layer. However, it is considered that wrinkles are formed on the resin film when laminatig, depending upon the shape of the transfer-receiving member and it is hence necessary to treat these wrinkles using a special machine such as a laminator, leading to increased steps.

SUMMARY OF THE INVENTION

In order to solve the above problem, therefore, an object of the present invention is to provide an intermediate transfer recording medium which is used to form an image on a transfer-receiving member and a protective layer on the image to thereby impart durability to the image perfectly and which can simply transfer the protective layer to the image accurately and to provide an image forming method.

The above object can be attained by the provision of an intermediate transfer recording medium according to the present invention, the intermediate transfer recording medium, in which a sheet substrate provided with a resin layer and a transparent sheet provided with a receptor layer are laminated on each other and the resin layer, is to be peeled from the transparent sheet, wherein a portion of the transparent sheet including the receptor layer is half-cut.

It is preferable to peel a portion, excluding an image-formed portion, in advance at the half-cut portion as the boundary to remove it.

Preferably a formation of the intermediate transfer recording medium is of a continuous rolling type.

It is desirable to provide a discrimination mark to detect the half-cut portion.

An image forming method according to the present invention comprises forming a transfer image on a receptor layer by using the aforementioned intermediate transfer recording medium and retransferring only the portion, on which the image is formed, to a transfer-receiving member to form an image.

In the image forming method, a transfer image is formed on a receptor layer using the aforementioned intermediate transfer recording medium, an adhesive layer is transferred to the receptor layer and only the portion on which the image and the adhesive layer are formed is retransferred to a transfer-receiving member to form an image.

The intermediate transfer recording medium of the present invention is characterized in that a sheet substrate provided with a resin layer and a transparent sheet provided with a receptor layer are laminated on each other such that the resin layer being to be peeled from the transparent sheet, wherein a portion of the transparent sheet including the receptor layer is provided with half-cut treatment. Using the intermediate transfer recording medium, a transfer image is formed on the receptor layer and only the image-formed portion is retransferred to the transfer-receiving member to form an image. At this time, a portion of the transparent sheet is cut at the half-cut portion as the boundary, forming a structure in which the transparent sheet covers the image-formed portion. Because the transparent sheet functions as a uniform and strong protective layer, necessary durability is imparted perfectly to the image. Also, since a portion of the transparent sheet is clearly cut at the half-cut portion, the protective layer can be simply transferred onto the image with high accuracy.

DESCRIPTION OF THE PREFERRED EMBODIMENTS

The present invention will now be explained by way of embodiments in more detail.

Figure 1:
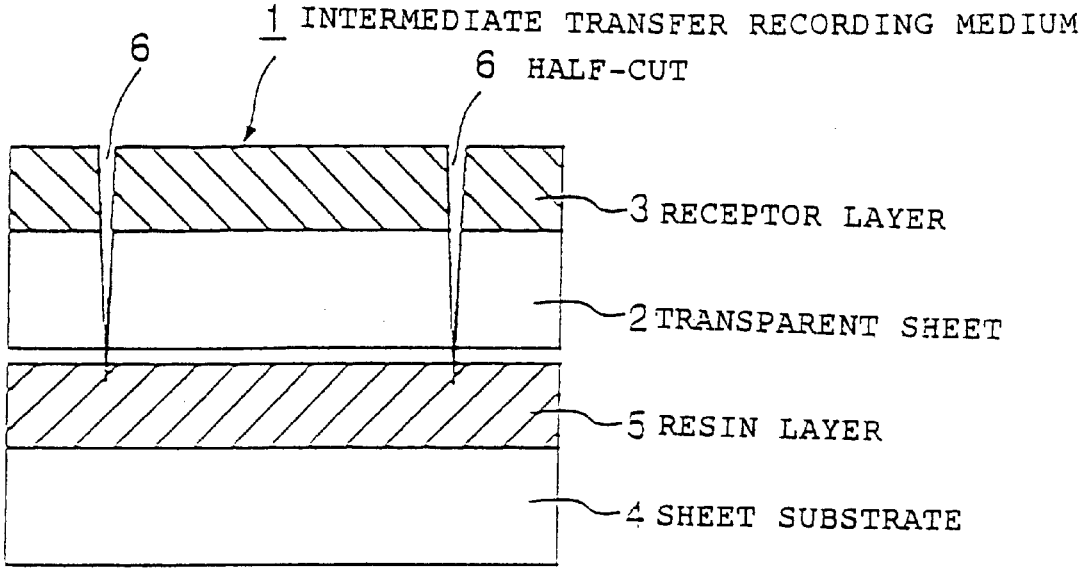
FIG. 1 is a sectional view showing an embodiment of an intermediate transfer recording medium according to the present invention.

FIG. 1 is a sectional view showing an embodiment of an intermediate transfer recording medium according to the present invention. An intermediate transfer recording medium 1 in this embodiment has a structure in which a sheet substrate 4 provided with a resin layer 5 and a transparent sheet 2 provided with a receptor layer 3 are laminated on each other, the resin layer 5 is to be peeled from the transparent sheet 2 at a portion between the resin layer 5 and the transparent sheet 2 and a portion of the transparent sheet 2 including the receptor layer 3 is processed by half-cut treatment 6.

Figure 2:
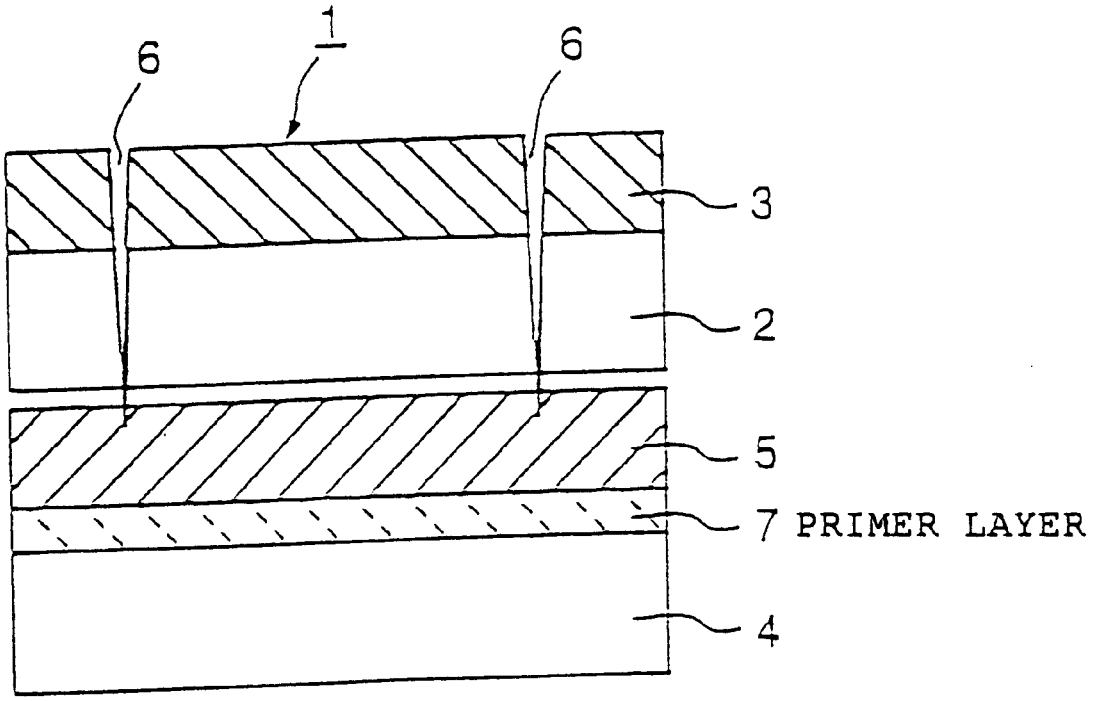
FIG. 2 is a sectional view showing another embodiment of an intermediate transfer recording medium according to the present invention.

FIG. 2 is a sectional view showing another embodiment of an intermediate transfer recording medium according to the present invention. An intermediate transfer recording medium 1 in this embodiment has a structure in which a sheet substrate 4 formed with a resin layer 5 thereon through a primer layer 7 and a transparent sheet 2 provided with a receptor layer 3 are laminated on each other, the resin layer 5 is to be peeled from the transparent sheet 2 at a portion between the resin layer 5 and the transparent sheet 2 and a portion of the transparent sheet 2 including the receptor layer 3 is processed by half-cut treatment 6.

Figure 3:
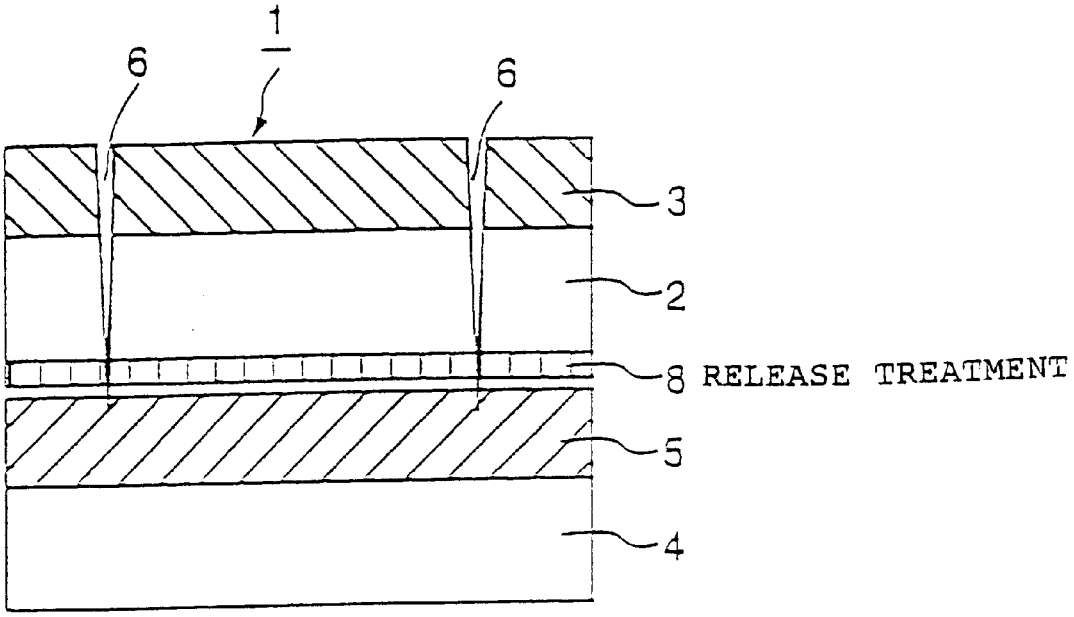
FIG. 3 is a sectional view showing a further embodiment of an intermediate transfer recording medium according to the present invention.

FIG. 3 is a sectional view showing a further embodiment of an intermediate transfer recording medium according to the present invention. An intermediate transfer recording medium 1 in this embodiment has a structure in which a sheet substrate 4 provided with a resin layer 5 is laminated on a transparent sheet 2 provided with a receptor layer 3 on one surface thereof, the other surface of the transparent sheet 2 being processed by releasing treatment 8, the resin layer 5 is to be peeled from the surface which has been processed by the releasing treatment 8 wherein a portion of the transparent sheet 2 including the receptor layer 3 and the portion which has been processed by the releasing treatment 8 are processed by half-cut treatment 6.

Figure 4:
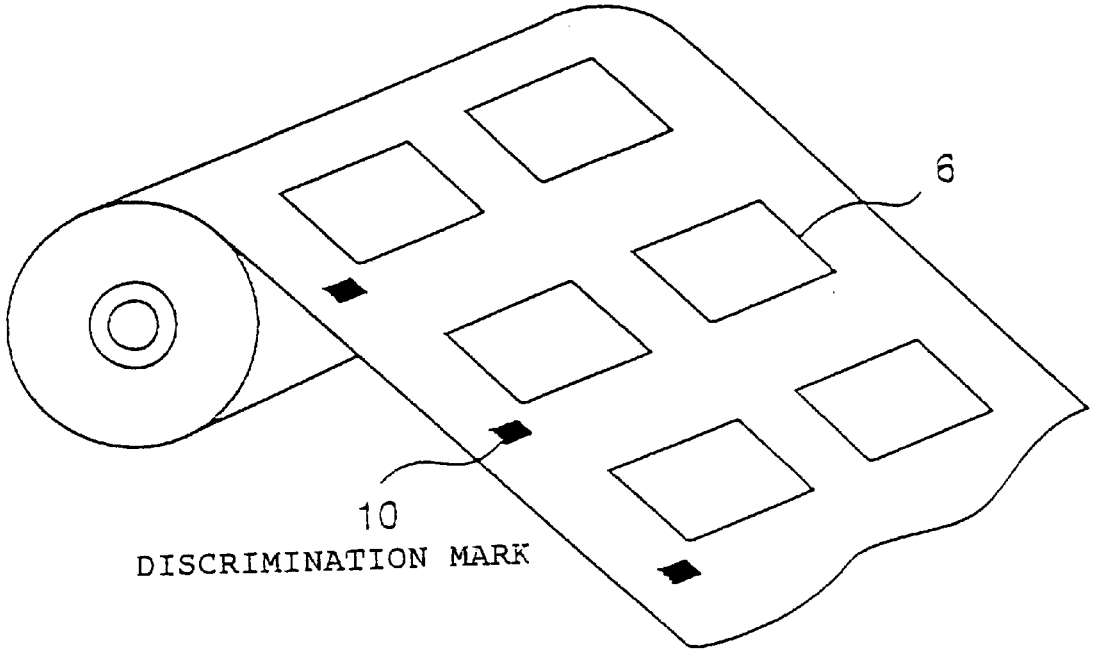
FIG. 4 is a schematic perspective view showing a continuous rolling condition of an intermediate transfer recording medium according to the present invention.

FIG. 4 is a schematic perspective view showing a continuous rolling condition of an intermediate transfer recording medium according to the present invention, wherein a discrimination mark 10 for detecting the portion which is processed by half-cut treatment 6 is formed.

Figure 5:
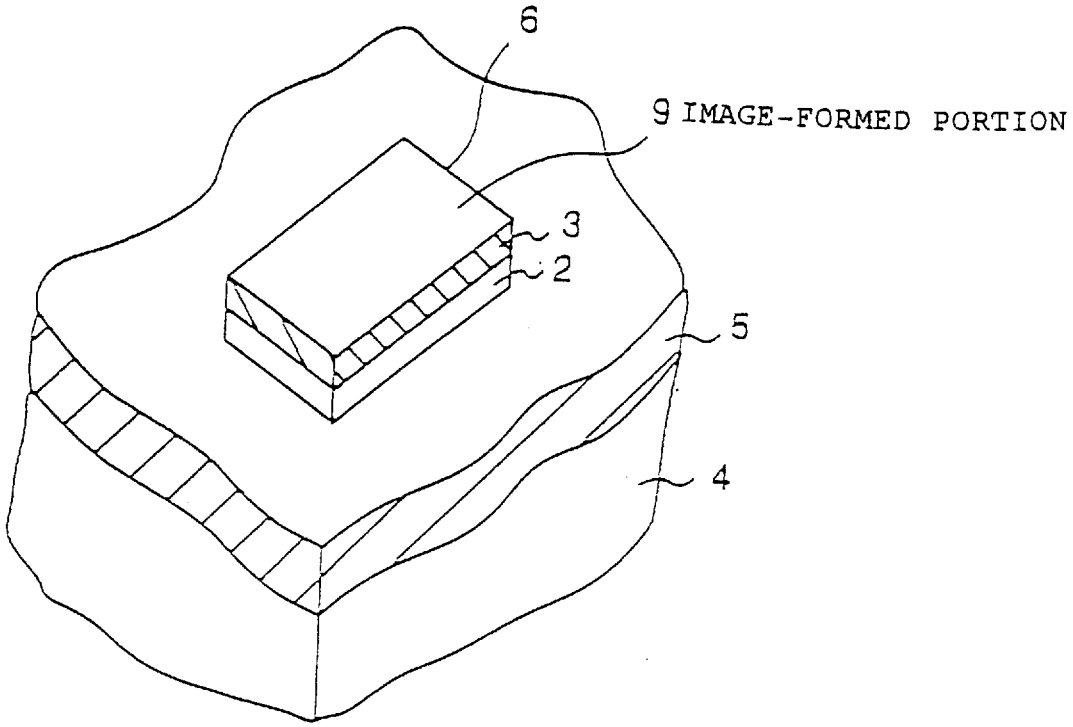
FIG. 5 is a schematic perspective view showing an embodiment of an intermediate transfer recording medium of the present invention, in which a portion excluding an image-formed portion is peeled off in advance at the half-cut portion as the boundary.

FIG. 5 is a schematic perspective view showing an embodiment of an intermediate transfer recording medium of the present invention in which a portion excluding the image-formed portion 9 is peeled off in advance at the portion, which is processed by the half-cut treatment 6, as the boundary.

A formation of the intermediate transfer recording medium is made to be of a continuous rolling type and a detection mark (not shown) is formed repeatedly at a constant position corresponding to a half-cut portion whereby an image is formed at an exact position enclosed by the half-cut portion.

(Transparent Sheet)

The transparent sheet 2 used in the intermediate transfer recording medium of the present invention functions as a protective layer in such a way that a portion of the transparent sheet is cut at the half-cut portion as the boundary and the image-formed portion is covered with the transparent sheet.

As the transparent sheet 2, any material may be used as far as it has transparency and durability regarding, for example, weather resistance, friction resistance and chemical resistance. Given as examples of materials used for the transparent sheet are a polyethylene terephthalate film, 1,4-polycyclohexylenedimethylene terephthalate film, polyethylene naphthalate film, polyphenylene sulfide film, polystyrene film, polypropylene film, polysulfone film, alamide film, polycarbonate film, polyvinyl alcohol film, cellophane, cellulose derivatives such as cellulose acetate, polyethylene film, polyvinyl chloride film, nylon film, polyimide film and ionomer film which have a thickness of about 0.5 to 100 $\mu$m and preferably 10 to 40 $\mu$m.

(Releasing Treatment)

The releasing treatment 8 is performed on the transparent sheet on the side facing the resin layer to make it easy to peel the resin layer from the transparent sheet.

The releasing treatment 8 is carried out to form a release layer on the transparent sheet. The release layer may be formed by applying an application solution containing waxes, silicone waxes, silicon resins, fluororesins, acrylic resins, polyvinyl alcohol resins, cellulose derivative resins or the like or copolymers of these resins by means of formation means such as a conventionally known gravure printing method, screen printing method or reverse roll coating method using a gravure print, followed by drying.

The thickness of the release layer is about 0.1 to 10 $\mu$m in dry condition.

(Receptor Layer)

The receptor layer 3 to be formed on the transparent sheet may be formed on the transparent sheet directly or via a primer layer. The structure of the receptor layer 3 differs depending upon a difference in recording system between the heat melting transfer recording and sublimation transfer recording. Also, in the heat melting transfer recording, a color transfer layer may be thermally transferred directly to the transparent sheet from the thermal transfer sheet without the receptor layer. The receptor layer used for heat melting transfer recording or sublimation transfer recording works to receive colorants transferred from the thermal transfer sheet by heating. In the case of using, particularly, a sublimation dye, it is desired that the receptor layer receive the dye to develop a color and prevent the dye once received from resublimating.

Using the intermediate transfer recording medium, a transfer image is formed on the receptor layer and only the image-formed portion is retransferred to the transfer-receiving member to form an image. It is general to allow the receptor layer to have transparency so that the image transferred to the transfer-receiving member can be observed clearly from the above. It is however possible to make the receptor layer dull or slightly colored intentionally to thereby characterize the retransferred image.

The receptor layer is usually constituted primarily of a thermoplastic resin. Examples of materials forming the receptor layer include polyolefin type resins such as polypropylene, polymer halides such as vinyl chloride/vinyl acetate copolymers, ethylene/vinyl acetate copolymers and polyvinylidene chlorides, polyester type resins such as polyvinyl acetate and polyacrylate, polystyrene type resins, polyamide type resins, copolymer type resins of olefins such as ethylene and propylene and other vinyl polymers, ionomers, cellulose type resins such as cellulose diacetate and polycarbonate type resins. Among these compounds, polyester type resins and vinyl chloride/vinyl acetate copolymers and mixtures of these compounds are preferable.

When an image is formed, a releasing agent may be mixed with the receptor layer in sublimation transfer recording to prevent the fusion of the thermal transfer sheet having a color transfer layer with the receptor layer of the intermediate transfer recording medium or to prevent a reduction in the sensitivity of a printed image. Examples of the releasing agent which is mixed in use include silicone oil, phosphate type surfactants and fluorine type surfactants and among these compounds, silicone oil is preferable. Preferable examples of silicone oil include modified silicone oils include epoxy-modified, vinyl-modified, alkyl-modified, amino-modified, carboxyl-modified, alcohol-modified, fluorine-modified, alkylaralkylpolyether-modified, epoxy/polyether-modified and polyether-modified silicone oils.

One or two or more types of releasing agent may be used. The amount of the releasing agent to be added is preferably 0.5 to 30 parts by weight based on 100 parts by weight of the receptor layer-forming resin. When the amount does not fall in the above range, problems such as the fusion of the sublimation thermal transfer sheet with the receptor layer of the intermediate transfer recording medium or a reduction in the sensitivity of a printed image will possibly be exerted. By addition of such a releasing agent to the receptor layer, the releasing agent is bled out on the surface of the receptor layer after being transferred to form a releasing layer. These releasing agents are not added to the receptor layer but may be applied to the receptor layer separately.

The receptor layer is formed by applying, to the transparent sheet, either a solution produced by dissolving such a resin as aforementioned, to which necessary additives, e.g., a releasing agent, are added, in an appropriate organic solvent or a dispersion in which the above resin is dispersed in an organic solvent or water, by using well-known forming means, e.g., a gravure coating, gravure reverse coating or roll coating method, followed by drying.

In the formation of the receptor layer, the thickness of the receptor layer, though it is optional, is usually 1 to 50$\mu$m measured in dry condition.

Although such a receptor layer is preferably a continuous coating, it may be formed as a discontinuous coating by using a resin emulsion, an aqueous resin or a resin dispersion. Moreover, an antistatic agent may be applied to the receptor layer to improve stability in the carriage of a thermal transfer printer.

(Sheet Substrate)

Examples of materials as the sheet substrate 4 used in the present invention include, though not particularly limited to, condenser paper, glassine paper, parchment paper, or high sizing paper such as synthetic paper (polyolefin types and polystyrene types), wood free paper, art paper, coated paper, cast-coated paper, wall paper, backing paper, synthetic resin- or emulsion-impregnated paper, synthetic rubber latex-impregnated paper, synthetic resin-addition paper and board, cellulose fiber paper, or films of polyester, polyacrylate, polycarbonate, polyurethane, polyimide, polyetherimide, cellulose derivatives, polyethylene, ethylene/vinyl acetate copolymer, polypropylene, polystyrene, acryl, polyvinyl chloride, polyvinylidene chloride, polyvinyl alcohol, polyvinylbutyral, nylon, polyether ether ketone, polysulfone, polyether sulfone, tetrafluoroethylene/perfluoroalkylvinyl ether, polyvinyl fluoride, tetrafluoroethylene/ethylene, tetrafluoroethylene/hexafluoropropylene, polychlorotrifluoroethylene, polyvinylidene fluoride and the like.

As the sheet substrate, those having a thickness of 10 $\mu$m to 100 $\mu$m are preferable. When the sheet substrate is too thin, the resulting intermediate transfer recording medium lacks in so-called nerve with the result that it cannot be carried by a thermal transfer printer and curls or wrinkles are produced on the intermediate transfer recording medium. On the other hand, when the sheet substrate is too thick, the resulting intermediate transfer recording medium becomes too thick and hence the power required to carry and drive by a thermal transfer printer becomes too large, which causes the failures of the printer and renders it impossible to carry the intermediate transfer recording medium.

(Resin Layer)

The resin layer 5 to be provided on the aforementioned sheet substrate may be formed by an adhesive layer, simplified adhesive layer or extrusion coating layer (EC).

The adhesive layer may be formed using any one of conventionally known solvent type or water type adhesives. Examples of the adhesive include vinyl acetate resin, acrylic resin, vinyl acetate/acryl copolymer, vinyl acetate/vinyl chloride copolymer, ethylene/vinyl acetate copolymer, polyurethane resin, natural rubber, chloroprene rubber and nitrile rubber.

The amount of the adhesive to be applied is about 8 to 30 g/m$^2$ (solid content) in general. The adhesive is applied to a release sheet by a conventionally known method, namely, such as a gravure coating, gravure reverse coating, roll coating, comma coating or die coating method and dried to form an adhesive layer. It is desirable that the adhesive strength of the adhesive layer in terms of peeling strength between the transparent sheet and the adhesive layer is in a range between 5 and 1,000 g approximately which is measured in a peeling method (180 degrees) according to JIS Z0237.

Preferably the type and amount of such an adhesive to be applied are selected in use such that the peeling strength falls in the above range when the adhesive layer is formed on the sheet substrate. When the adhesive layer is formed on the sheet substrate and the transparent sheet is laminated on the adhesive layer, a method such as dry lamination or hot melt lamination of an adhesive layer may be adopted.

Preferably the simplified adhesive layer is formed on the sheet substrate by a conventionally well-known application method using styrene/butadiene copolymer rubber (SBR), acrylonitrile/butadiene copolymer rubber (NBR), a latex of an acrylic resin such as a polyacrylate, gummy resin, waxes or mixtures of these compounds and the transparent sheet and the simplified adhesive layer are laminated by dry lamination under heat. The simplified adhesive layer, after the transparent sheet is peeled from the sheet substrate, is reduced in adhesiveness so that the transparent sheet cannot be reapplied to the sheet substrate.

When such a simplified adhesive layer is used, a primer layer may be disposed between the sheet substrate and the simplified adhesive layer.

As the resin layer of the present invention, an EC layer may be formed on the sheet substrate.

Although no particular limitation is imposed on the thermoplastic resin for forming the EC layer insofar as it does not essentially adhere to the transparent sheet and it is a resin having extrusion processability, a polyolefin type resin which is not essentially adherent to PET films utilized usually for transparent sheets and has excellent processability is particularly preferable. Specifically, an LDPE, MDPE, HDPE, PP resin or the like may be used. When each of these resins is extruded for coating, a mat roll is used as a cooling roll. The surface of the mat is thereby transferred to the surface of the EC layer to provide the surface with fine irregularities, whereby opacity can be imparted to the EC layer.

Also, a white pigment, e.g., calcium carbonate and titanium oxide, is kneaded and mixed with the above polyolefin type resin to form an opaque EC layer.

The EC layer is unnecessary a single layer and may be composed of two or more layers.

The peeling strength from the transparent sheet can be controlled by the process temperature in the extrusion processing step and the type of resin.

In this manner, the sheet substrate and the transparent sheet may be laminated on each other through the EC layer by so-called EC lamination at the same time when the EC layer is formed on the sheet substrate by extrusion processing.

(Primer Layer)

When the resin layer is formed on the aforementioned sheet substrate, a primer layer 7 is formed on the surface of the sheet substrate to improve the adhesion between the sheet substrate and the resin layer. In addition, corona discharge treatment may be performed on the surface of the sheet substrate instead of using the primer layer.

The primer layer may be formed in the same method as the aforementioned measures for the formation of the receptor layer by using an application solution in which a polyester type resin, polyacrylate type resin, polyvinyl acetate type resin, polyurethane type resin, polyamide type resin, polyethylene type resin or polypropylene type resin is dissolved or dispersed in a solvent.

The thickness of the primer layer is about 0.1 to 5 $\mu$m measured in dry condition.

It is to be noted that the aforementioned primer layer may be likewise formed between the transparent sheet and the receptor layer.

On the surface of the sheet substrate on the side opposite to the surface on which the resin layer is formed, a proper slip layer (not shown) may be formed to improve the carriage ability of a thermal transfer printer when paper is fed. As the slip layer, a material may be used in which a lubricant, e.g., various fine particle and silicone, is added to a single one or mixture of well-known resins such as a butyral resin, polyacrylate, polymethacrylate, polyvinylidene chloride, polyester, polyurethane, polycarbonate and polyvinyl acetate.

The intermediate transfer recording medium of the present invention has a structure in which at least a receptor layer, a transparent sheet, a resin layer and a sheet substrate are laminated in this order and the resin layer is peelablely, put on from the transparent sheet. An antistatic layer may be formed on the outermost face (or faces) of the surface of the receptor layer or the backface of the sheet substrate or both surfaces. The antistatic layer may be formed by applying a material produced by dissolving or dispersing an antistatic agent such as a fatty acid ester, sulfate, phosphate, amides, quaternary ammonium salt, betaines, amino acids, acrylic resin and ethylene oxide addition product in a solvent. For the formation of the antistatic layer, the same measures as in the case of the aforementioned receptor layer may be used. The amount of the antistatic layer is preferably 0.001 to 0.1 g/m$^2$ measured in dry condition.

An intermediate layer composed of each of various resins may be disposed between the transparent sheet substrate and the receptor layer. Preferably the intermediate layer has transparency to observe the retransferred image.

By making the intermediate layer play various roles, excellent functions may be added to the image-receiving sheet. For instance, a resin which tends to be largely deformed elastically or plastically, for example, a polyolefin type resin, vinyl type copolymer resin, polyurethane type resin or polyamide type resin is used as a resin imparting cushion ability to improve the printing sensitivity of the image-receiving sheet and to prevent the roughness of an image. In order to impart antistatic capability to the intermediate layer, the aforementioned antistatic agent is added to the above resin used for imparting cushion ability, the resin mixture is dissolved or dispersed in a solvent and the resulting solution or dispersion is further applied to form an intermediate layer.

(Half-Cut)

In the intermediate transfer recording medium of the present invention, the treatment of the half-cut 6 is performed on a portion of the transparent sheet including the receptor layer. Examples of the method for the formation of the half-cut include a method in which the intermediate transfer recording medium is inserted between an upper die with a cutter blade attached thereto and a pedestal and the upper die is moved up and down, a method using a cylinder type rotary cutter and a method in which heat-treating processing is performed by means of laser processing although no particular limitation is imposed on the method insofar as it is a method enabling the sheet to be half-cut.

As shown in FIG. 5, a portion excluding the image-formed portion 9 is peeled off in advance at the half-cut portion 6 as the boundary and hence the receptor layer 3 formed on the transparent sheet 2 is left only in the image-formed portion 9 when an image is formed. Thus, a portion of the transparent sheet is not cut at the half-cut portion when an image is retransferred to the transfer-receiving member and hence the image-formed portion is surely transferred to the image-receiving member.

The half-cut portion 6 shown in FIG. 4 is produced by continuously cutting every unit of one cycle. In this case, uncut (no cut present) portions are formed in parts, for example, on four corners to thereby prevent the half-cut portion from peeling off in handling, for instance, during carriage of a thermal transfer printer. It is desirable that, in the above process, the length of the uncut is designed to be of a dimension as short as about 0.1 to 0.5 mm so that the uncut portion is fused and the portion including the half-cut and enclosed by the continuous one cycle range is transferred to the transfer-receiving member when the image-formed portion is retransferred to the transfer receiving member.

It is possible to provide treatment using sewing scores formed with repeated half-cut and uncut instead. As the sewing scores, those in which the length of the cut portion is 2 mm to 5 mm and the length of the uncut portion is about 0.1 mm to 0.5 mm are preferably used.

The above sewing scores may be formed by processing according to a method in which the intermediate transfer recording medium is inserted between an upper die with a sewing blade attached thereto and a pedestal and the upper die is moved up and down or a method using a cylinder type rotary cutter.

When, in the half-cut treatment, the cut portion is so deep in the depth direction thereof that not only a portion of the transparent sheet but also the sheet substrate is cut, the intermediate transfer recording medium is cut at the half-cut-processed portion during carriage of a printer, causing carriage troubles to occur easily. On the other hand, when, in the half-cut treatment, the cut portion is so shallow in the depth direction that, for example, only the receptor layer is provided with a half-cut but the transparent sheet is not provided with a half-cut, the resin layer is not occasionally peeled from the transparent sheet when the image-formed portion is retransferred to the transfer-receiving member.

It is therefore desirable that, as shown in FIG. 1 to FIG. 3, the processed half-cut is deepened to such an extent as to penetrate the receptor layer and the transparent sheet and to intrude a little into the resin layer in the thickness direction thereof.

The half-cut according to the present invention may be formed in advance before an image is formed on the receptor layer of the intermediate transfer recording medium explained above. It is also possible to carry out half-cut processing in accordance with the image zone after an image is formed on the receptor layer of the intermediate transfer recording medium.

(Discrimination Mark)

The intermediate transfer recording medium of the present invention may be provided with a discrimination mark 10 to detect the half-cut portion.

The types of shape and color of the discrimination mark may be those which can be detected by a detector and there is no limitation to these types. As shown in FIG. 4, the shape maybe, for example, a square, circle, bar cord or line extending from one end to the other end of the intermediate transfer recording medium in the width direction thereof.

The color of the discrimination mark may be those detectable using a detector. For instance, in the case of using a light-transmission type detector, examples of the color include a silver and a black color having high masking ability and in the case of using a light-reflecting type detector, examples of the color include metallic glossy hues having high reflectivity.

Various methods may be used for the formation of the discrimination mark and there is no limitation to the method. For instance, the discrimination mark is formed by making a hole penetrating from the surface to the backface of the intermediate transfer recording medium, by gravure printing or offset printing, by forming a deposition film using a transfer foil by means hot stamp or by applying a deposition film with an adhesive to the backface.

(Image Forming Method)

In the image-forming method of the present invention, using the intermediate transfer recording medium explained above, the intermediate transfer recording medium is overlapped on the thermal transfer sheet such that the transfer layer of the thermal transfer sheet is in contact with the receptor layer, followed by heating to form a transfer image on the receptor layer. Then, the intermediate transfer recording medium and the transfer-receiving member are put together such that the surface of the receptor layer is in contact with the transfer-receiving member and heated and pressed to retransfer only the image-formed portion to the transfer-receiving member thereby forming an image.

When the image-formed portion and the transfer-receiving member are put together and heated and applied to each other under pressure, the image-formed portion is included in the area to be heated and applied under pressure and even if the area to be heated and applied under pressure is different a little in size from the portion enclosed by the half-cut, a portion of the transparent sheet is clearly cut at the half-cut portion because a portion of the transparent sheet including the receptor layer is half-cut. Hence the transparent sheet, namely an image with the protective layer can be transferred simply with high accuracy.

Also, using the aforementioned intermediate transfer recording medium, it is overlapped on the thermal transfer sheet such that the transfer layer of the thermal transfer sheet is in contact with the receptor layer, followed by heating to form a transfer image on the receptor layer. Further, the adhesive layer is transferred to the receptor layer and the intermediate transfer recording medium and the transfer-receiving member are put together such that the surface of the adhesive layer is in contact with the transfer-receiving member and heated and pressed to retransfer only the portion, on which the image and the adhesive layer are formed, to the transfer-receiving member thereby forming an image.

Details concerning the transfer of the adhesive layer to the receptor layer will be hereinafter explained.

In order to transfer the adhesive layer to the receptor layer, using an adhesive sheet which is made into, for example, a film form, the adhesive layer is inserted between the image-formed receptor layer and the transfer-receiving member, which are then heated and applied under pressure, whereby the image-receiving layer and the transparent sheet can be stuck to the transfer-receiving layer.

Also, using an adhesive layer transfer sheet in which an adhesive layer is formed on a release paper, the adhesive layer of the adhesive layer transfer sheet is applied under heat and pressure to the receptor layer, on which an image is formed, to thereby transfer the adhesive layer.

As the adhesive component used for the above adhesive sheet or adhesive layer transfer sheet, a thermoplastic synthetic resin, natural resin, rubber, wax or the like may be used. Given as examples of the adhesive component are cellulose derivatives such as ethyl cellulose and cellulose acetate propionate, styrene copolymers such as polystyrene and poly α-methylstyrene, acrylic resins such as methyl polymethacrylate, ethyl polymethacrylate and ethyl polyacrylate, vinyl type resins such as polyvinyl chloride, polyvinyl acetate, vinyl chloride/vinyl acetate copolymers and polyvinylbutyral, synthetic resins such as polyester resins, polyamide resins, epoxy resins, polyurethane resins, ionomers, olefins and ethylene/acrylic acid copolymers and derivatives of natural resins or synthetic rubbers such as rosin used as an adhesion-donator, rosin modified maleic acid resins, ester rubber, polyisobutylene rubber, butyl rubber, styrene-butadiene rubber and butadiene-acrylonitrile rubber. These adhesive components are used singly or in combinations of two or more and it is preferable to use material exhibiting adhesiveness by heating.

The thickness of the adhesive layer of the adhesive sheet or adhesive layer transfer sheet is 0.1 to 500 μm.

Examples of heating means when the above adhesive layer is transferred include a thermal head and line heater used when a transfer image is formed, heat roll and hot stamp.

To form an image on the intermediate transfer recording medium, a conventionally known sublimation type thermal transfer system or heat melting type thermal transfer system may be used. For instance, using a thermal transfer sheet in which color transfer layers of three colors, namely yellow, cyan and magenta, are alternately provided side by side, a desired full-color image is formed on the receptor layer of the intermediate transfer recording medium by a known thermal transfer printer using a thermal head system or laser heating system. Next, the transparent sheet including the receptor layer on which an image is formed is peeled from the sheet substrate provided with the resin layer and transferred and applied to an optional transfer-receiving member.

Moreover, it is necessary to form a mirror image with respect to the final image on the receptor layer of the intermediate transfer recording medium in the present invention so that the image finally obtained on the transfer-receiving member faces correctly.

No particular limitation is imposed on materials of the transfer-receiving member on which an image retransferred from the intermediate transfer recording medium is to be formed. For example, any sheet of plain paper, wood free paper, tracing paper, plastic films and the like may be used. As to its shape, any of a card, postcard, passport, letter paper, report paper, notes, catalogues, cups, cases and the like may be used.

EXAMPLES

The present invention will be explained in more detail by way of examples and comparative examples, in which all designations of parts and % indicate parts by weight and weight percentage (wt.%), respectively, unless otherwise noted.

Example 1

First, a receptor layer having the composition described below was formed on a transparent sheet of a 25 μm-thick polyethylene terephthalate film (LUMILAR, manufactured by Toray Industries, Inc.) in a thickness of 4 μm measured in dry condition. Next, using a 38-μm-polyethylene terephthalate film (LUMILAR, manufactured by Toray Industries, Inc.) as a sheet substrate, a resin layer having the composition described below was formed on the sheet substrate in a thickness of 3 μm measured in dry condition. The surface of the transparent sheet on which no receptor layer was formed was put together with the resin layer to laminate the transparent sheet on the sheet substrate by dry lamination.

Half-cut treatment was carried out, as shown in FIG. 1 and FIG. 4, on the above laminate product, specifically, on a portion of the transparent sheet including the receptor layer using a press system consisting of an upper die with a cutter blade attached thereto and a pedestal to prepare a continuous rolling type intermediate transfer recording medium of Example 1. The above resin layer was designed to be peeled from the transparent sheet at a portion between the resin layer and the transparent sheet.

Composition of an Application Solution for Receptor Layer

| | |
|---|---|
| Vinyl chloride/vinyl acetate copolymer (VYHD, manufactured by Union Carbide Co., Ltd.) | 100 parts |
| Epoxy-modified silicone (KF-393, manufactured by Shin-Etsu Chemical Co., Ltd.) | 8 parts |
| Amino-modified silicone (KS-343, manufactured by Shin-Etsu Chemical Co., Ltd.) | 8 parts |
| Methyl ethyl ketone/toluene (1/1 by weight) | 400 parts |

Composition of an Application Solution for Resin Layer

| | |
|---|---|
| NBR type resin (NIPPOLE SX1503, manufactured by Nippon Zeon Co., Ltd.) | 30 parts |
| Carnauba wax (WE188, manufactured by KONISHO CO., LTD.) | 0.6 parts |
| Water | 35 parts |
| Isopropyl alcohol | 35 parts |

Example 2

The same procedures as in Example 1 were carried out, except that the composition of the application solution for resin layer of Example 1 was changed to that described below, to prepare an intermediate transfer recording medium of Example 2

Composition of an Application Solution for Resin Layer

| | |
|---|---|
| Acrylic resin latex (LX874, manufactured by Nippon Zeon Co., Ltd.) | 30 parts |
| Water | 35 parts |
| Isopropyl alcohol | 35 parts |

Example 3

A receptor layer was formed on a transparent sheet in the same condition as in Example 1. Next, using a 38-μm-polyethylene terephthalate film (LUMILAR, manufactured by Toray Industries, Inc.) as a sheet substrate, a resin in which 15% of titanium oxide was dispersed in a low density polyethylene (LDPE) was laminated on the sheet substrate in a thickness of 40 μm by using an extrusion coating method. The sheet substrate was laminated on the surface of the above transparent sheet, on which no receptor layer was formed, through the LDPE layer by EC lamination at the same time when the extrusion processing was performed.

Moreover, half-cut treatment was carried out, as shown in FIG. 5, on the above laminate product, specifically, on a portion of the transparent sheet including the receptor layer by using a press system consisting of an upper die with a cutter blade attached thereto and a pedestal and a portion excluding an image-formed portion was peeled off in advance at the half-cut portion as the boundary to prepare a continuous rolling type intermediate transfer recording medium of Example 2. The above resin layer was designed to be peeled from the transparent sheet at a portion between the resin layer and the transparent sheet.

Comparative Example 1

On a 25-μm-thick polyethylene terephthalate film (LUMILAR, manufactured by Toray Industries, Inc.), a peelable layer having the composition described below was formed such that its thickness in dry condition was 1 μm. On the peelable layer, a receptor layer was formed using the application solution for receptor layer used in Example 1 in a thickness of 3 μm measured in dry condition and on the receptor layer, an adhesive layer having the composition 1 described below was formed in a thickness of 3 μm measured in dry condition to prepare a receptor layer transfer sheet.

On a 25-μm-thick polyethylene terephthalate film (LUMILAR, manufactured by Toray Industries, Inc.), a peelable layer was formed using the application solution for peelable layer which was used for the above receptor layer transfer sheet such that its thickness in dry condition was 1 μm. On the peelable layer, a protective layer having the composition described below was formed in a thickness of 3 μm measured in dry condition and on the protective layer, an adhesive layer having the composition 2 described below was formed in a thickness of 3 μm measured in dry condition to prepare a protective layer transfer sheet.

Composition of an Application Solution for Peelable Layer

| | |
|---|---|
| Polyvinyl alcohol resin (AH-17, manufactured by The Nippon Synthetic Chemical Industry Co., Ltd.) | 100 parts |
| Water | 400 parts |

Composition 1 of an Application Solution for Adhesive Layer

| | |
|---|---|
| Polymethylmethacrylate resin (BR-106, manufactured by Mitsubishi Rayon Co., Ltd.) | 100 parts |
| Foaming agent (F-50, manufactured by Matsumoto Oil and Fat Pharmaceutical Co., Ltd.) | 15 parts |
| Titanium oxide (TCA-888, manufactured by Tochem Products Co., Ltd.) | 100 parts |
| Methyl ethyl ketone/toluene (1/1 by weight) | 300 parts |

Composition of an Application Solution for Protective Layer

| | |
|---|---|
| Vinyl chloride/vinyl acetate copolymer (VYHD, manuf actured by Union Carbide Co., Ltd.) | 100 parts |
| Methyl ethyl ketone/toluene (1/1 by weight) | 400 parts |

Composition 2 of an Application Solution for Adhesive Layer

| | |
|---|---|
| Acrylic resin (BR-106, manufactured by Mitsubishi Rayon Co., Ltd.) | 100 parts |
| Methyl ethyl ketone/toluene (1/1 by weight) | 300 parts |

Using the above samples prepared in Examples and Comparative Examples, an image was formed on the receptor layer in the following condition and, in the sample prepared in Comparative Example 1, a protective layer was further formed on the image-receiving layer.

A thermal transfer sheet (manufactured by Dai Nippon Printing Co., Ltd.) in which dye layers, specifically, color transfer layers of three colors, namely yellow, magenta and cyan, were alternately provided side by side was overlapped on each of the intermediate transfer recording media of the above examples such that each color transfer layer faces the receptor layer. A recording operation was carried out by a thermal transfer printer using a thermal head from the backface of the thermal transfer sheet in the following condition: voltage applied to the head: 12.0 V, pulse width: 16 msec, printing cycle: 33.3 msec and dot density: 6 dots/line, to form an image (mirror image) of a full-color photograph of a face on the receptor layer of the intermediate transfer recording medium.

Next, the receptor layer of the above intermediate transfer recording medium on which an image was formed was laid on a PET card used as a transfer receiving member and the receptor layer was stuck to the PET card under pressure between a thermal head and a platen roll. Energy was applied to the portion where the image was formed in the following condition: 160 mJ/mm$^2$ and printing speed: 33.3 msec/line (feed pitch: 6 line/mm) to bond the image-receiving layer with the transfer-receiving member. Thereafter, the sheet substrate was peeled off to retransfer only the portion of the transfer-receiving member on which the image was formed to form an image.

In the samples of Examples 1 and 2, further, a portion of the transparent sheet was cut at the half-cut portion as the boundary, forming the structure in which the image-formed portion was covered with the transparent sheet. Therefore, the transparent sheet functioned as a uniform and strong protective layer, providing the image with durability perfectly. Also, since a portion of the transparent sheet was clearly cut at the half-cut portion, the protective layer could be simply transferred on the image with high accuracy.

As to the sample of Example 3, because a portion excluding the image-formed portion had been peeled off in advance at the half-cut portion as the boundary, a portion of the transparent sheet was not cut, thereby forming the structure in which the image-formed portion was covered with the transparent sheet. Therefore, the transparent sheet functioned as a uniform and strong protective layer, providing the image with durability perfectly. Also, the protective layer could be transferred to the image more simply with high accuracy.

As to the sample prepared in Comparative Example 1, a PET card as a transfer-receiving member was laid on the receptor transfer sheet to transfer the receptor layer to the PET card by using a thermal head. Next, the same thermal transfer sheet that was used in the recording of the aforementioned intermediate transfer recording medium was overlapped on the surface of the receptor layer and using a thermal head, an image (mirror image) of a full-color photograph of a face was formed on the receptor layer in the following condition: voltage applied to the head: 12.0 V, pulse width: 16 msec, printing cycle: 33.3 msec and dot density: 6 dots/line.

Moreover, using a protective layer transfer sheet, a protective layer was transferred on the image-formed portion by applying energy using a thermal head to form an image on the transfer-receiving member.

Next, the samples prepared in Examples and Comparative Examples were subjected to a Taber's abrasion resistance test. As for the test condition, using an abrasion wheel CS-10, a load of 500 g was applied to the image to perform a 1400 times-cycle test. The results are shown as follows.

It was visually observed whether or not the image was disappeared by abrasion.

TABLE 1

| | Taber's abrasion resistance test |
|---|---|
| Example 1 | OK (Image was not disappeared) |
| Example 2 | OK (Image was not disappeared) |
| Example 3 | OK (Image was not disappeared) |
| Comparative Example 1 | NG (Image was disappeared) |

What is claimed is:

1. An intermediate transfer recording medium in which a sheet substrate provided with a resin layer and a transparent sheet provided with a receptor layer are laminated on each other and the resin layer is to be peeled from the sheet substrate, wherein a portion of the transparent sheet including the receptor layer is half-cut.

2. An intermediate transfer recording medium according to claim 1, wherein a portion excluding an image-formed portion is peeled off in advance at said half-cut portion as the boundary.

3. An intermediate transfer recording medium according to claim 2, wherein said intermediate transfer recording medium is of a continuous rolling type.

4. An intermediate transfer recording medium according to claim 2, the intermediate transfer recording medium further comprising a discrimination mark to detect said half-cut portion.

5. An image forming method, wherein a transfer image is formed on a receptor layer by using the intermediate transfer recording medium according to claim 2 and only the portion, on which the image is formed, is retransferred to a transfer-receiving member to form an image.

6. An image forming method, wherein a transfer image is formed on a receptor layer by using the intermediate transfer recording medium according to claim 2, an adhesive layer is transferred to the receptor layer and only the portion, on which the image and the adhesive layer are formed, is retransferred to a transfer-receiving member to form an image.

7. An intermediate transfer recording medium according to claim 1, wherein said intermediate transfer recording medium is of a continuous rolling type.

8. An intermediate transfer recording medium according to claim 7, the intermediate transfer recording medium further comprising a discrimination mark to detect said half-cut portion.

9. An image forming method, wherein a transfer image is formed on a receptor layer by using the intermediate transfer recording medium according to claim 7 and only the portion, on which the image is formed, is retransferred to a transfer-receiving member to form an image.

10. An image forming method, wherein a transfer image is formed on a receptor layer by using the intermediate transfer recording medium according to claim 7, an adhesive layer is transferred to the receptor layer and only the portion, on which the image and the adhesive layer are formed, is retransferred to a transfer-receiving member to form an image.

11. An intermediate transfer recording medium according to claim 1, the intermediate transfer recording medium further comprising a discrimination mark to detect said half-cut portion.

12. An image forming method, wherein a transfer image is formed on a receptor layer by using the intermediate transfer recording medium according to claim 11 and only the portion, on which the image is formed, is retransferred to a transfer-receiving member to form an image.

13. An image forming method, wherein a transfer image is formed on a receptor layer by using the intermediate transfer recording medium according to claim 11, an adhesive layer is transferred to the receptor layer and only the portion, on which the image and the adhesive layer are formed, is retransferred to a transfer-receiving member to form an image.

14. An image forming method, wherein a transfer image is formed on a receptor layer by using the intermediate transfer recording medium according to claim 1 and only the portion, on which the image is formed, is retransferred to a transfer-receiving member to form an image.

15. An image forming method, wherein a transfer image is formed on a receptor layer by using the intermediate transfer recording medium according to claim 1, an adhesive layer is transferred on the receptor layer and only the portion, on which the image and the adhesive layer are formed, is retransferred to a transfer-receiving member to form an image.

* * * * *

UNITED STATES PATENT AND TRADEMARK OFFICE

CERTIFICATE OF CORRECTION

PATENT NO. : 6,284,708 B1
DATED : September 4, 2001
INVENTOR(S) : Oshima et al.

It is certified that error appears in the above-identified patent and that said Letters Patent is hereby corrected as shown below:

Title page,
Item [30], replace "11-041440" with -- 11-41441 --.

Signed and Sealed this

Seventh Day of May 2002

*Attest:*

*Attesting Officer*

JAMES E. ROGAN
*Director of the United States Patent and Trademark Office*